US010625837B2

(12) United States Patent
Ichikawa et al.

(10) Patent No.: US 10,625,837 B2
(45) Date of Patent: Apr. 21, 2020

(54) TILT-TRIM SYSTEM FOR OUTBOARD MOTOR

(71) Applicant: YAMAHA HATSUDOKI KABUSHIKI KAISHA, Iwata-shi, Shizuoka (JP)

(72) Inventors: Noriyoshi Ichikawa, Iwata (JP); Hiroki Sato, Iwata (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 16/443,218

(22) Filed: Jun. 17, 2019

(65) Prior Publication Data

US 2020/0094932 A1 Mar. 26, 2020

(30) Foreign Application Priority Data

Sep. 21, 2018 (JP) ..... 2018-177914

(51) Int. Cl.
*B63H 20/10* (2006.01)

(52) U.S. Cl.
CPC ..... *B63H 20/10* (2013.01)

(58) Field of Classification Search
CPC ..... B63H 20/10
See application file for complete search history.

(56) References Cited

U.S. PATENT DOCUMENTS

| | | | | |
|---|---|---|---|---|
| 4,898,563 | A * | 2/1990 | Torigai | B63H 20/10 440/1 |
| 5,007,866 | A * | 4/1991 | Okita | B63H 21/265 440/61 D |
| 6,220,905 | B1 * | 4/2001 | Blanchard | B63H 20/10 440/61 F |
| 6,994,046 | B2 * | 2/2006 | Kaji | B63H 25/04 114/144 R |
| 9,919,781 | B1 * | 3/2018 | Andrasko | B63J 99/00 |
| 10,518,856 | B2 * | 12/2019 | Andrasko | G05D 1/0206 |
| 2014/0030939 | A1 | 1/2014 | Kanno | |

FOREIGN PATENT DOCUMENTS

| | | |
|---|---|---|
| JP | 2012166573 A | 9/2012 |
| JP | 2014-024501 A | 2/2014 |

OTHER PUBLICATIONS

The extended search report of the corresponding European Patent Application No. 19197215.7, dated Feb. 24, 2020.

* cited by examiner

*Primary Examiner* — Stephen P Avila
(74) *Attorney, Agent, or Firm* — Global IP Counselors, LLP

(57) ABSTRACT

A controller controls a tilt-trim device under an automatic control mode such that the tilt-trim device automatically causes an outboard motor to continuously perform a tilt-trim motion within a motion range set in advance when an operation has been performed the plurality of times within the predetermined period of time. The controller deactivates the tilt-trim device when the outboard motor reaches either an upper limit or a lower limit of the motion range. The controller changes the motion range in accordance with a setting signal for setting the motion range when receiving the setting signal.

11 Claims, 8 Drawing Sheets

TILT-TRIM SYSTEM FOR OUTBOARD MOTOR

TECHNICAL FIELD

The present invention relates to a tilt-trim system for an outboard motor.

BACKGROUND

There has been conventionally known a tilt-trim device that causes an outboard motor attached to a watercraft to perform a tilt-trim motion (e.g., Japan Laid-open Patent Application Publication No. 2014-024501). The tilt-trim device includes, for instance, a motor and a tilt shaft extending in the right-and-left direction. When the motor is driven, the outboard motor is rotated about the tilt shaft. Accordingly, the outboard motor performs the tilt-trim motion such that the lower part thereof elevates or lowers.

The outboard motor or an operator seat is provided with an operating switch for operating the tilt-trim device. The operating switch is, for instance, a push-button switch. An operator is capable of operating the tilt-trim motion of the outboard motor by pushing the operating switch.

SUMMARY

In the well-known tilt-trim device, the operator is required to continuously push the operating switch when the outboard motor is caused to perform the tilt-trim motion. This is bothersome for the operator. It is an object of the present invention to enhance convenience in operation for causing the outboard motor to perform the tilt-trim motion.

A tilt-trim system for an outboard motor according to a first aspect includes a tilt-trim device, an operating switch and a controller. The operating switch is a switch for operating the tilt-trim device. The controller is connected to the tilt-trim device and the operating switch. The controller has having a processor that is programmed to execute the following processing. The controller determines whether or not an operation of the operating switch has been performed a plurality of times within a predetermined period of time upon receiving a signal indicating the operation from the operating switch. The controller controls a tilt-trim device under an automatic control mode upon determining the operation has been performed the plurality of times within the predetermined period of time. Under the automatic control mode, the controller controls the tilt-trim device such that the tilt-trim device automatically causes the outboard motor to continuously perform the tilt-trim motion within a motion range set in advance. The controller deactivates the tilt-trim device upon determining the outboard motor reaches either an upper limit or a lower limit of the motion range. The controller changes the motion range in accordance with a setting signal for setting the motion range when receiving the setting signal.

A method according to a second aspect relates to a method of controlling a tilt-trim device causing an outboard motor to perform a tilt-trim motion. The method includes the following processing. First processing refers to receiving a signal indicating an operation of an operating switch for operating the tilt-trim device. Second processing refers to determining whether or not the operation has been performed a plurality of times within a predetermined period of time. Third processing refers to controlling the tilt-trim device under an automatic control mode such that the tilt-trim device automatically causes the outboard motor to continuously perform the tilt-trim motion within a motion range set in advance upon the operating switch being the plurality of times within the predetermined period of time. Fourth processing refers to deactivating the tilt-trim device upon the outboard motor reaching either an upper limit or a lower limit of the motion range. Fifth processing refers to changing the motion range in accordance with a setting signal for setting the motion range upon receiving the setting signal.

According to the present invention, the tilt-trim motion of the outboard motor can be automatically continued under the automatic control mode without a continuous operation of the operating switch by an operator. Additionally, the tilt-trim motion of the outboard motor is automatically stopped when the outboard motor reaches either the upper limit or the lower limit of the motion range set in advance, and the motion range can be arbitrarily changed by the setting signal. Accordingly, convenience in operation for causing the outboard motor to perform the tilt-trim motion can be enhanced.

DETAILED DESCRIPTION OF THE PREFERRED EMBODIMENTS

Figure 1:
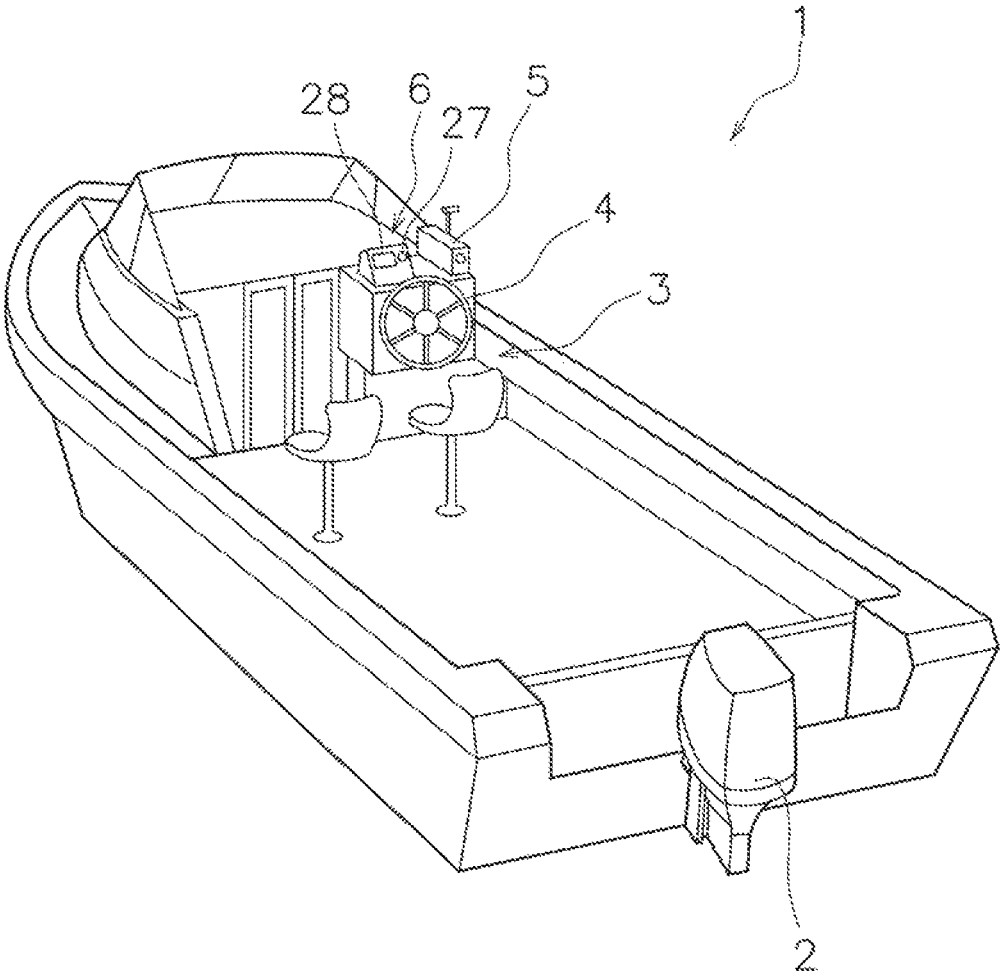
FIG. 1 is a perspective view of a watercraft in which a control system for an outboard motor according to a preferred embodiment is installed.

A preferred embodiment will be hereinafter explained with reference to the drawings. FIG. 1 is a perspective view of a watercraft 1 in which a control system for an outboard motor 2 according to the preferred embodiment is installed. The outboard motor 2 is attached to the stem of the watercraft 1. The outboard motor 2 generates a thrust for propelling the watercraft 1. In the present preferred embodiment, the single outboard motor 2 is mounted to the watercraft 1, but alternatively, two or more outboard motors 2 may be mounted to the watercraft 1.

The watercraft 1 includes an operator seat 3. The operator seat 3 is provided with a steering member 4, a first remote control 5 and a second remote control 6. The steering member 4 is a member for allowing an operator to operate the turning direction of the watercraft 1. The steering member 4 is, for instance, a steering wheel. The first remote control 5 is a device for allowing the operator to regulate the velocity of the watercraft 1. The first remote control 5 is also a device for allowing the operator to switch between forward movement and backward movement of the watercraft 1. The second remote control 6 will be described below.

Figure 2:
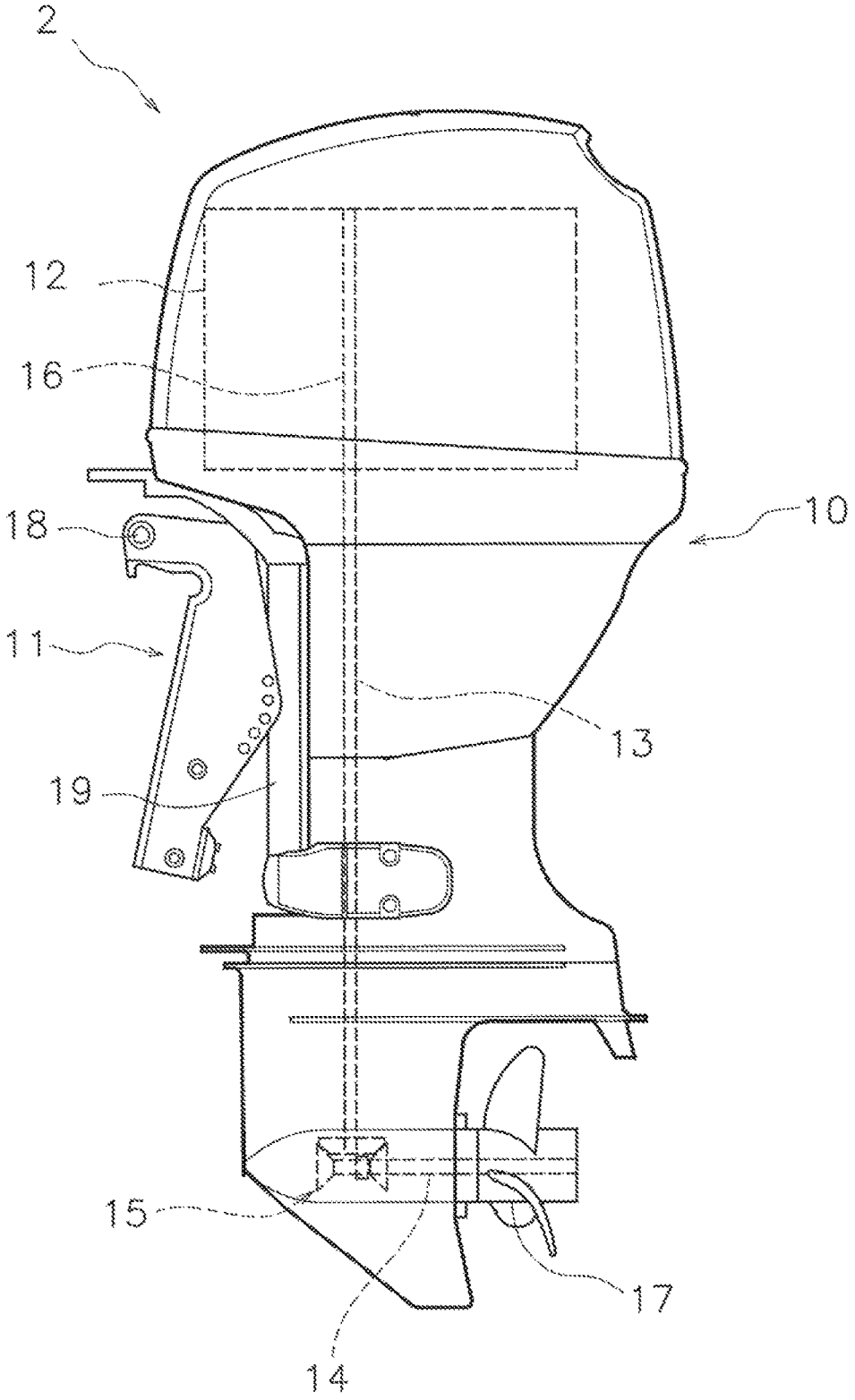
FIG. 2 is a side view of the outboard motor.

FIG. 2 is a side view of the outboard motor 2. The outboard motor 2 includes an outboard motor body 10 and a bracket 11. The outboard motor body 10 is attached to the watercraft 1 through the bracket 11. The outboard motor body 10 includes an engine 12, a driveshaft 13, a propeller shaft 14 and a shift mechanism 15.

The engine 12 generates the thrust for propelling the watercraft 1. The engine 12 includes a crankshaft 16. The crankshaft 16 extends in the vertical direction. The driveshaft 13 is connected to the crankshaft 16. The driveshaft 13 extends in the vertical direction. The propeller shaft 14 extends in the back-and-forth direction. The propeller shaft 14 is connected to the driveshaft 13 through the shift mechanism 15. A propeller 17 is connected to the propeller shaft 14.

The shift mechanism 15 switches the rotational direction of power to be transmitted from the driveshaft 13 to the propeller shaft 14. For example, the shift mechanism 15 includes a plurality of gears and a clutch that changes meshing of gears.

The bracket 11 includes a tilt-trim shaft 18 and a steering shaft 19. The tilt-trim shaft 18 extends in the right-and-left direction. The bracket 11 supports the outboard motor body 10 such that the outboard motor body 10 is rotatable about the tilt-trim shaft 18. The steering shaft 19 extends in the vertical direction. The bracket 11 supports the outboard motor body 10 such that the outboard motor body 10 is rotatable about the steering shaft 19.

Figure 3:
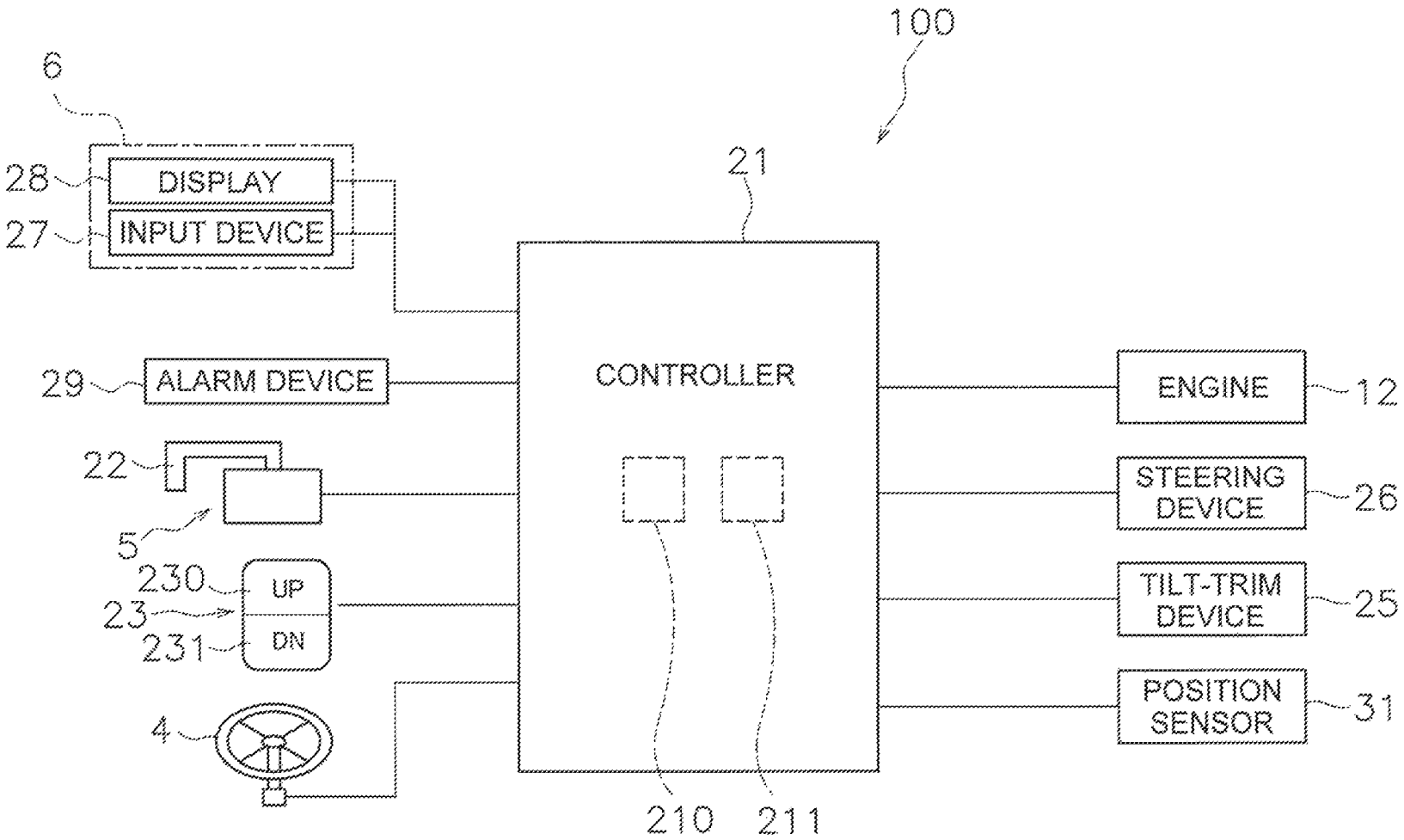
FIG. 3 is a schematic diagram of the control system for the outboard motor.

FIG. 3 is a schematic diagram showing a control system 100 for the outboard motor 2. As shown in FIG. 3, the control system 100 for the outboard motor 2 includes a controller 21 (e.g., an electronic controller). The terms "controller" and "electronic controller" as used herein refer to hardware that executes a software program and does not include a human. The controller 21 includes a processor 210 such as a CPU and a memory 211 including a RAM, a ROM and so forth. The controller 21 stores a program and data for controlling the outboard motor 2. The controller 21 is communicably connected to the steering member 4, the first remote control 5 and the second remote control 6, all of which are described above, through wired or wireless communication.

The steering member 4 is rotatable right and left from a middle position. The steering member 4 outputs an operating signal, which indicates the position thereof to the controller 21. The first remote control 5 includes a throttle member 22. The throttle member 22 is, for instance, a throttle lever. The throttle member 22 is operable from a zero operation position to a forwardly moving directional side and a backwardly moving directional side. The first remote control 5 outputs an operating signal, which indicates the position of the throttle member 22, to the controller 21.

The controller 21 receives the operating signal, i.e., a signal indicating the operating amount of the throttle member 22, from the first remote control 5. The controller 21 outputs a command signal to the engine 12 such that the engine rotational speed is increased or reduced in accordance with the operating amount of the throttle member 22. Therefore, the operator can regulate the velocity of the watercraft 1 by operating the throttle member 22.

The control system 100 for the outboard motor 2 includes a steering device 26. The steering device 26 rotates the outboard motor body 10 about the steering shaft 19 so as to turn the outboard motor body 10 in the right-and-left direction. The steering device 26 includes, for instance, a hydraulic pump and a hydraulic cylinder. Alternatively, the steering device 26 may include another type of actuator such as an electric motor.

The controller 21 receives the operating signal, i.e., a signal indicating the operating amount and the operating direction of the steering member 4, from the steering member 4. The controller 21 outputs a command signal to the steering device 26 such that the outboard motor body 10 is turned in the right-and-left direction in accordance with the operating amount and the operating direction of the steering member 4. Therefore, the operator is capable of regulating the moving direction of the watercraft 1 by operating the steering member 4.

The second remote control 6 includes an input device 27 and a display 28. The input device 27 outputs a signal indicating an operation performed by the operator. The input device 27 is a touchscreen, for instance, and detects an operation of at least one software key displayed on the display 28. Alternatively, the input device 27 may include at least one hard key and may detect an operation of the at least one hard key. The display 28 is, for instance, an LCD (Liquid Crystal Display) or an OLED (Organic Light Emitting Diode) display. Alternatively, the display 28 may be of another type. The display 28 displays a screen in accordance with a command signal transmitted thereto from the controller 21.

The control system 100 for the outboard motor 2 includes an alarm device 29. The alarm device 29 outputs predetermined alert information in accordance with a command signal transmitted thereto from the controller 21. The alarm device 29 includes, for instance, a speaker, and the alert information takes the form of an alarm sound (a buzzer sound, etc.) to be outputted from the speaker. Alternatively, the alarm device 29 may be, for instance, an warning light (a rotary light, etc.), and the alert information may take the form of light to be emitted from the warning light.

The control system 100 for the outboard motor 2 includes a tilt-trim device 25. The tilt-trim device 25 rotates the outboard motor body 10 about the tilt-trim shaft 18 so as to tilt the outboard motor body 10 in the up-and-down direction. The tilt-trim device 25 includes, for instance, an electric motor. Alternatively, the tilt-trim device 25 may include another type of actuator such as a hydraulic motor.

The control system 100 for the outboard motor 2 includes a position sensor 31. The position sensor 31 detects a position of the outboard motor 2 performing a tilt-trim motion (hereinafter referred to as "a tilt-trim position"). The tilt-trim position is, for instance, the tilt-trim angle of the outboard motor 2 and indicates the height of the outboard motor 2 to be changed by the tilt-trim motion. The position sensor 31 outputs a signal, indicating the tilt-trim position, to the controller 21.

The control system 100 for the outboard motor 2 includes a PTT switch 23. The PTT switch 23 is an operating switch for causing the outboard motor 2 to perform the tilt-trim motion. The PTT switch 23 is disposed on, for instance, the outboard motor body 10. Alternatively, the PTT switch 23 may be disposed on another device such as the first remote control 5.

The PTT switch 23 includes an UP button and a DN button 231. The UP button 230 is operated for elevating the outboard motor 2. The DN button 231 is operated for lowering the outboard motor 2. The PIT switch 23 is a momentary switch. Specifically, while being pressed, each of the UP button 230 and the DN button 231 is kept in an operational state and outputs a signal indicating an operation thereof. While being not pressed, each of the UP button 230 and the DN button 231 is kept in a nonoperational state.

When the PTT switch 23 is operated, the signal, which indicates the operation of the PTT switch 23, is outputted to the controller 21. The controller 21 controls the tilt-trim device 25 in response to the operation of the PTT switch 23.

Figure 4:
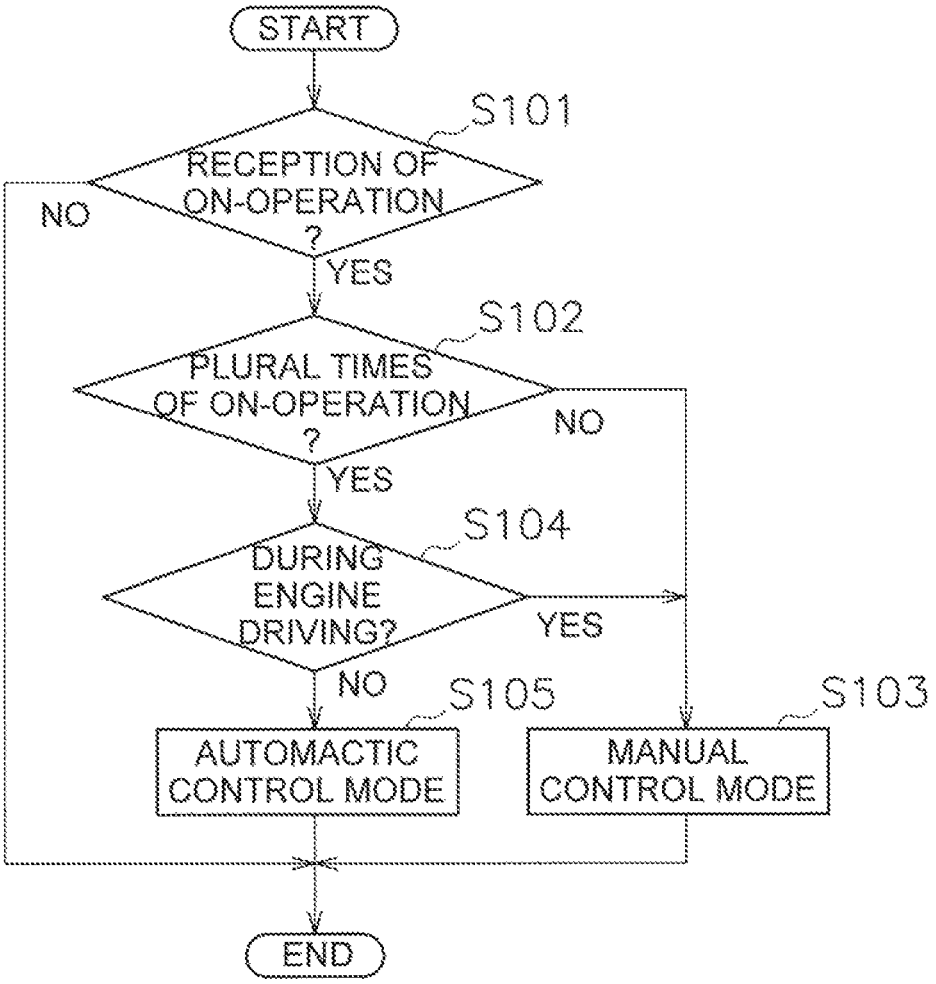
FIG. 4 is a flowchart showing processing for controlling a tilt-trim device.

Processing executed by the controller 21 for controlling the tilt-trim device 25 will be hereinafter explained. FIG. 4 is a flowchart showing the processing for controlling the tilt-trim device 25.

In step S101, the controller 21 determines whether or not it has received the signal indicating the operation of the PTT switch 23. When the controller 21 has not received the signal indicating the operation of the PTT switch 23, the tilt-trim device 25 is kept in a deactivated state. When the controller 21 has received, from the PIT switch 23, the signal indicating the operation of the PTT switch 23, the processing proceeds to step S102.

In step S102, the controller 21 determines whether or not the operation of the PTT switch 23 has been performed a plurality of times within a predetermined period of time. The controller 21 herein determines that the operation of the PTT switch 23 has been performed the plurality of times within the predetermined period of time when the controller 21 has intermittently received the signal indicating the operation of the PTT switch 23 the plurality of times within the predetermined period of time. Detailedly, the controller 21 determines whether or not the UP button 230 has been operated a predetermined plurality of times or more within the predetermined period of time. Additionally, the controller 21 determines whether or not the DN button 231 has been operated the predetermined plurality of times or more within the predetermined period of time. For example, the controller 21 determines whether or not the aforementioned operation has been performed twice or more in one second.

When the operation of the PTT switch 23 has not been performed the plurality of times within the predetermined period of time, the processing proceeds to step S103. For example, when the operation of the PTT switch 23 has been continuously performed only once for the predetermined period of time or more, the processing proceeds to step S103.

In step S103, the controller 21 controls the tilt-trim device 25 under a manual control mode. Under the manual control mode, the controller 21 activates the tilt-trim device 25 only while the operation of the PTT switch 23 is being continued. For example, while the operation of the UP button 230 is being continued, the controller 21 controls the tilt-trim device 25 so as to continuously elevate the outboard motor 2. When the UP button 230 stops being operated and returns to the original position thereof, the controller 21 deactivates the tilt-trim device 25. On the other hand, while the operation of the DN button 231 is being continued, the controller 21 controls the tilt-trim device 25 so as to continuously lower the outboard motor 2. When the DN button 231 stops being operated and returns to the original position thereof, the controller 21 deactivates the tilt-trim device 25.

However, under the manual control mode, the tilt-trim motion of the outboard motor 2 is performed within a range of a full trim-in position and a full tilt-out position. The full trim-in position indicates the lowest position of the outboard motor 2 performing the tilt-trim motion. The full tilt-out position indicates the highest position of the outboard motor 2 performing the tilt-trim motion. When the outboard motor 2 reaches the full trim-in position under the manual control mode, the tilt-trim device 25 is deactivated even when the DN button 231 is being operated. Likewise, when the outboard motor 2 reaches the full tilt-out position under the manual control mode, the tilt-trim device 25 is deactivated even when the UP button 230 is being operated.

On the other hand, when the operation of the PTT switch 23 has been performed the plurality of times within the predetermined period of time in step S102, the processing proceeds to step S104. Specifically, when the operation of either the UP button 230 or the DN button 231 has been performed the predetermined plurality of times or more within the predetermined period of time, the processing proceeds to step S104. In step S104, the controller 21 determines whether or not the engine 12 is being driven. The controller 21 determines whether or not the engine 12 is being driven based on, for instance, a signal transmitted thereto from a sensor for detecting the rotational speed of the engine 12. It should be noted that the controller 21 determines that the engine 12 is being driven even when the engine 12 is idling.

When the controller 21 determines that the engine 12 is being driven in step S104, the controller 21 controls the tilt-trim device 25 under the manual control mode in step S103. When the controller 21 determines that the engine 12 is not being driven in step S104, the processing proceeds to step S105.

In step S105, the controller 21 controls the tilt-trim device 25 under an automatic control mode. Under the automatic control mode, the controller 21 automatically continues the tilt-trim motion of the outboard motor 2 within a motion range set in advance. For example, when the operation of the UP button 230 has been performed the plurality of times within the predetermined period of time, the controller 21 automatically continues the tilt-trim motion, by which the outboard motor 2 is elevated, within the motion range set in advance even after stop of the operation of the UP button 230. Alternatively, when the operation of the DN button 231 has been performed the plurality of times within the predetermined period of time, the controller 21 automatically continues the tilt-trim motion, by which the outboard motor 2 is lowered, within the motion range set in advance even after stop of the operation of the DN button 231.

Figure 5:
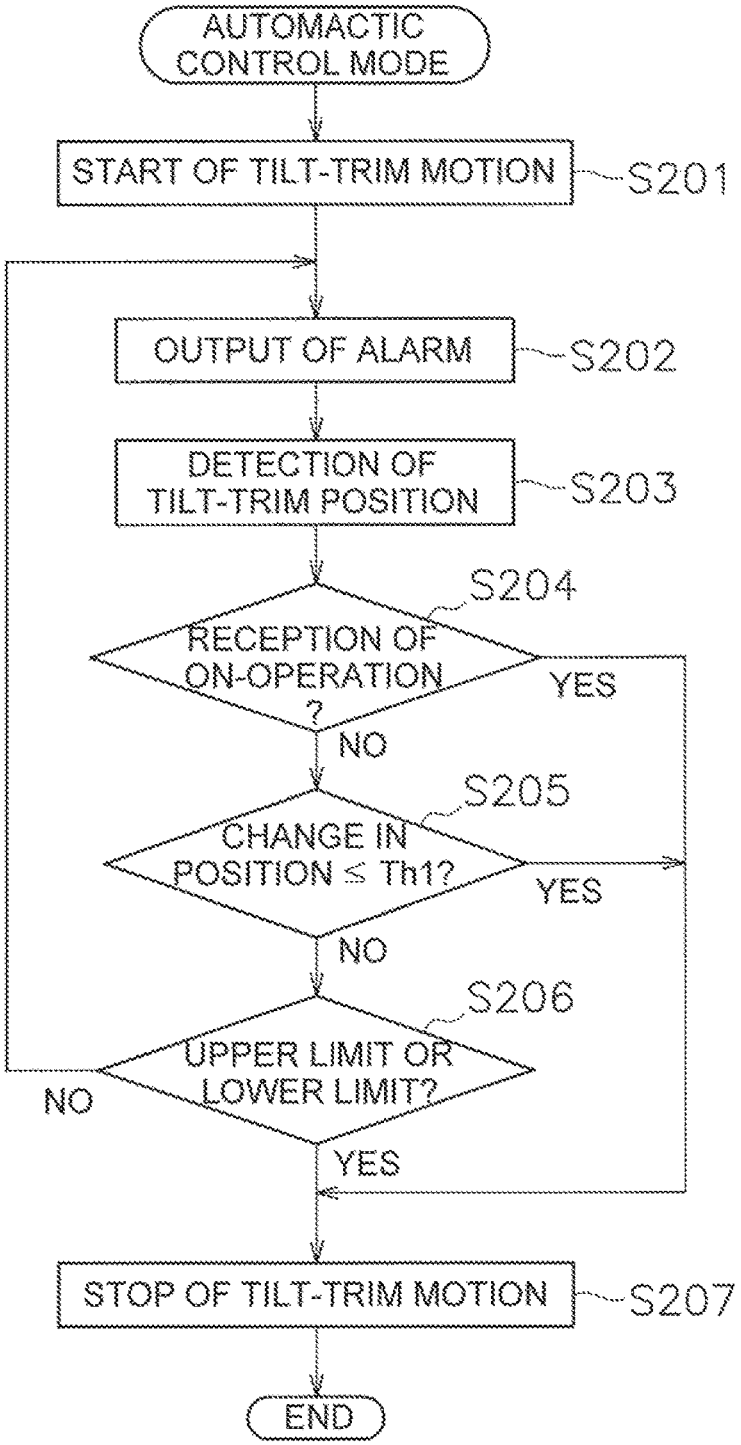
FIG. 5 is a flowchart showing processing executed by a controller under an automatic control mode.

FIG. 5 is a flowchart showing processing executed by the controller 21 under the automatic control mode. As shown in FIG. 5, in step S201, the controller 21 controls the tilt-trim device 25 so as to start the tilt-trim motion. In more detail, when the automatic control mode is started by performing the operation of the UP button 230 the plurality of times within the predetermined period of time, the controller 21 causes the tilt-trim device 25 to start the tilt-trim motion by which the outboard motor 2 is elevated. When the automatic control mode is started by performing the operation of the DN button 231 the plurality of times within the predetermined period of time, the controller 21 causes the tilt-trim device 25 to start the tilt-trim motion by which the outboard motor 2 is lowered.

In step S202, the controller 21 outputs alarm. The controller 21 herein outputs the command signal to the alarm device 29 so as to cause the alarm device 29 to output an alarm sound. The controller 21 causes the alarm device 20 to output the alarm sound during the tilt-trim motion under the automatic control mode.

In step S203, the controller 21 detects the tilt-trim position. The controller 21 herein detects the tilt-trim position based on the signal transmitted thereto from the position sensor 31.

In step S204, the controller 21 determines whether or not it has received the signal, indicating the operation of the PTT switch 23, from the PTT switch 23. When the controller 21 determines that it has received the signal indicating the operation of the PIT switch 23 from the PTT switch 23, the controller 21 causes the tilt-trim device 25 to stop the tilt-trim motion in step S207. For example, the controller 21 deactivates the tilt-trim device 25 when detecting that the PTT switch 23 has been operated once during the tilt-trim motion of the outboard motor 2 under the automatic control mode. When the controller 21 determines that it has not received the signal indicating the operation of the PTT switch 23 from the PIT switch 23, the tilt-trim motion is continued and the processing proceeds to step S205.

In step S205, the controller 21 determines whether or not a value of change in the tilt-trim position of the outboard motor 2 within the predetermined period of time is less than or equal to a predetermined threshold Th1. The controller 21 obtains the value of change in the tilt-trim position of the outboard motor 2 based on the signal transmitted thereto from the position sensor 31. Values of the predetermined period of time and the threshold Th1 are set to be appropriate for detecting a foreign object getting stuck in at least either the tilt-trim device 25 or the bracket 11. When the value of change in the tilt-trim position of the outboard motor 2 within the predetermined period of time is less than or equal to the predetermined threshold Th1, the controller 21 causes the tilt-trim device 25 to stop the tilt-trim motion in step S207. When the value of change in the tilt-trim position of the outboard motor 2 within the predetermined period of time is greater than the predetermined threshold T hl, the tilt-trim motion is continued and the processing proceeds to step S206.

In step S206, the controller 21 determines whether or not the tilt-trim position has reached either a predetermined upper limit position or a predetermined lower limit position. Both the upper limit position and the lower limit position have been preliminarily set and stored in the controller 21. Both the upper limit position and the lower limit position are set to tall in the range of the full trim-in position and the full tilt-out position. When the tilt-trim position has reached either the predetermined upper limit position or the predetermined lower limit position, the controller 21 causes the tilt-trim device 25 to stop the tilt-trim motion in step S207. Accordingly the controller 21 ends the automatic control mode.

It should be noted that the motion range of the outboard motor 2 under the automatic control mode, i.e., the aforementioned upper limit position and lower limit position can be changed. When having received a setting signal for setting the motion range from the input device 27, the controller 21 changes the motion range in accordance the setting signal. FIG. 6A is a flowchart showing processing for setting the upper limit position. FIG. 61 is a flowchart showing processing for setting the lower limit position.

Figure 6B:
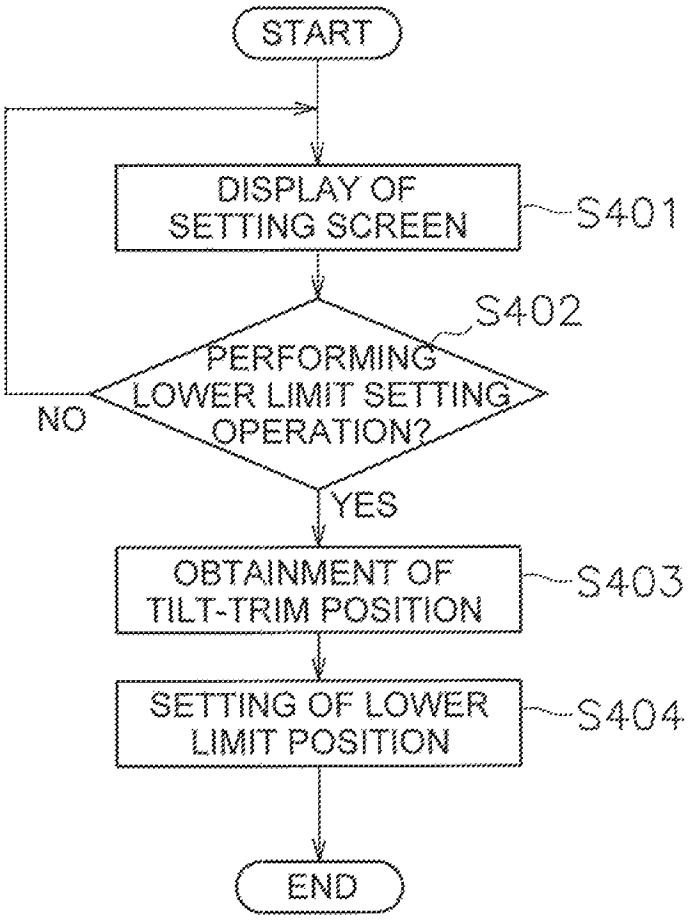
FIGS. 6A and 6B are flowcharts showing processing for setting a motion range.
Figure 6A:
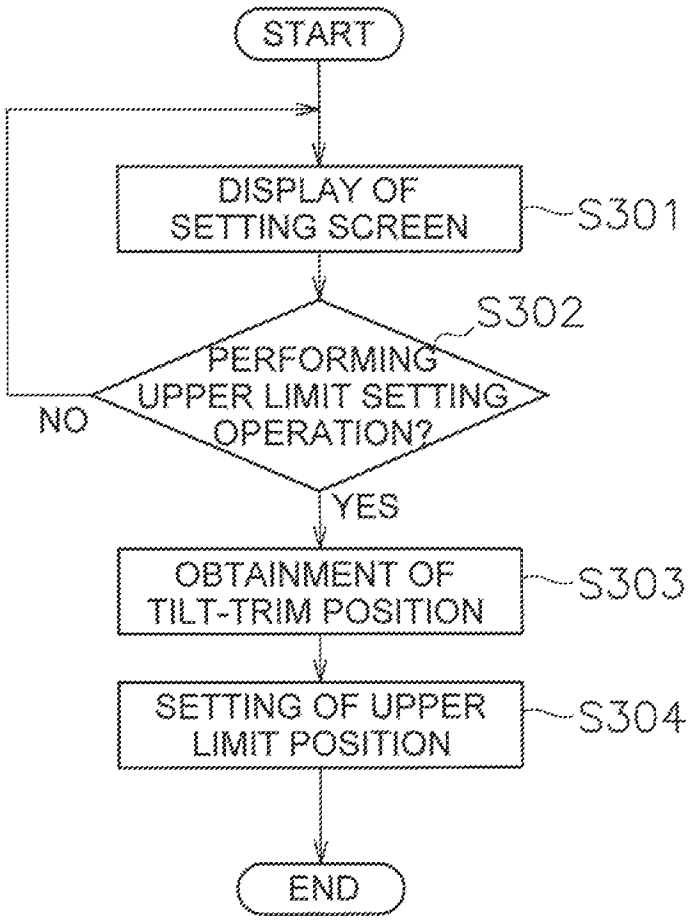
Figure 7:
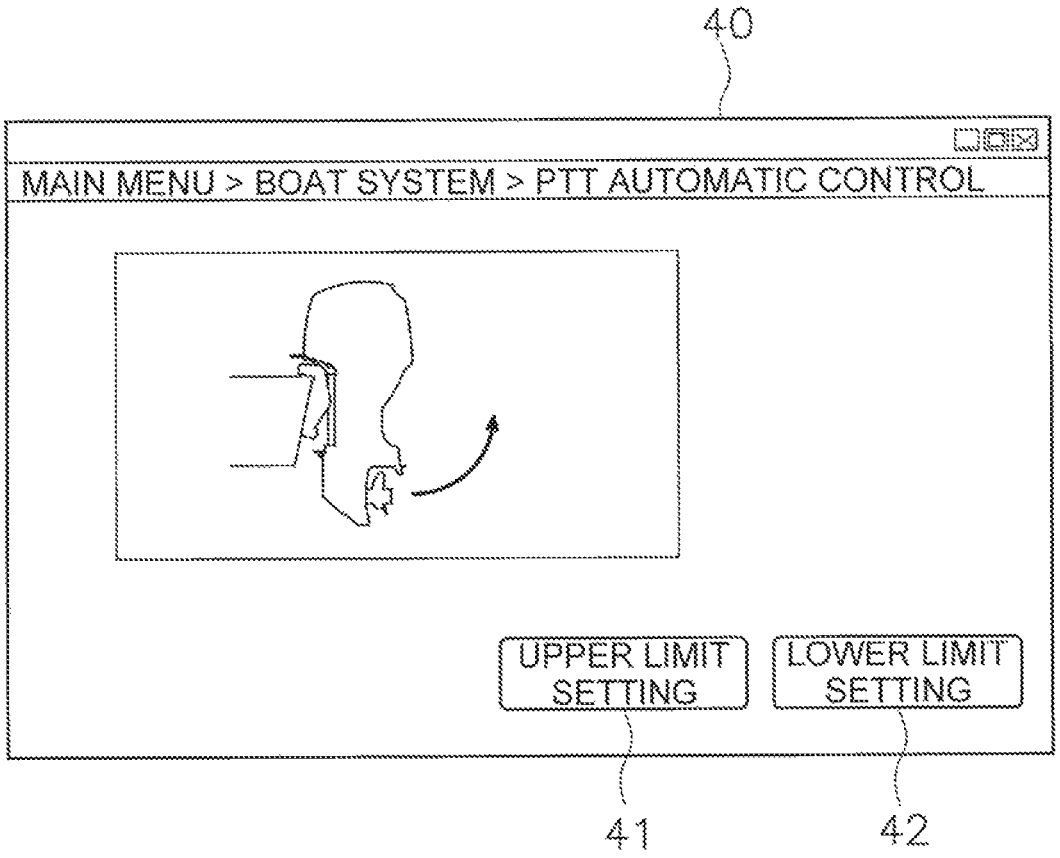
FIG. 7 is a diagram showing an exemplary setting screen.

As shown in FIG. 6A, in step S301, the controller 21 causes the display 28 to display a setting screen 40 for setting the motion range. FIG. 7 is a diagram showing an example of the setting screen 40. As shown in FIG. 7, the setting screen 40 includes an upper limit setting button 41 and a lower limit setting button 42.

In step S302, the controller 21 determines whether or not an upper limit setting operation has been performed. The controller 21 determines that the upper limit setting operation has been performed when having received a signal, indicating an operation of the aforementioned upper limit setting button 41, from the input device 27. When the controller 21 determines that the upper limit setting operation has been performed, the processing proceeds to step S303.

In step S303, the controller 21 obtains the tilt-trim position based on the signal transmitted thereto from the position sensor 31. The controller 21 obtains the tilt-trim position of the outboard motor 2 at the point of time that the upper limit setting operation has been performed. Then in step S304, the controller 21 sets the obtained tilt-trim position of the outboard motor 2 as the upper limit position, and stores the tilt-trim position set as the upper limit position in the memory 211. For example, a user moves the outboard motor 2 to a desired position by operating the PTT switch 23 to cause the outboard motor 2 to perform the tilt-trim motion. It should be noted that at this time, the outboard motor 2 is moved within the range of the full trim-in position and the full tilt-out position. When the user then operates the upper limit setting button 41, the controller 21 sets the tilt-trim position of the outboard motor 2 at this point of time as the upper limit position and stores the tilt-trim position set as the upper limit position in the memory 211.

As shown in FIG. 6B, the controller 21, as does in step S301, similarly causes the display 28 to display the setting screen 40 in step S401. In step S402, the controller 21 determines whether or not a lower limit setting operation has been performed. The controller 21 determines that the lower limit setting operation has been performed when having received a signal indicating an operation of the aforementioned lower limit setting button 42 firm the input device 27. When the controller 21 determines that the lower limit setting operation has been performed, the processing proceeds to step S403.

In step S403, the controller 21 obtains the tilt-trim position based on the signal transmitted thereto from the position sensor 31. The controller 21 obtains the tilt-trim position of the outboard motor 2 at the point of time that the lower limit setting operation has been performed. Then in step S404, the controller 21 sets the obtained tilt-trim position of the outboard motor 2 as the lower limit position, and stores the tilt-trim position set as the lower limit position in the memory 211. For example, the user moves the outboard motor 2 to a desired position by operating the PTT switch 23 to cause the outboard motor 2 to perform the tilt-trim motion. It should be noted that at this time, the outboard motor 2 is moved within the range of the full trim-in position and the full tilt-out position. When the user then operates the lower limit setting button 42, the controller 21 sets the tilt-trim position of the outboard motor 2 at this point of time as the lower limit position and stores the tilt-trim position set as the lower limit position in the memory 211. It should be noted that default values are looked up and used as the upper and lower limits of the tilt-trim position before setting the upper and lower limits.

In the control system 100 for the outboard motor 2 according to the present preferred embodiment explained above, the tilt-trim motion can be automatically continued under the automatic control mode without continuously operating the PTT switch 23.

Either the automatic control mode or the manual control mode is selected depending on the frequency of operating the UP button 230 within the predetermined period of time. Also, either the automatic control mode or the manual control mode is selected depending on the frequency of operating the DN button 231 within the predetermined period of time. Because of this, the control mode for controlling the tilt-trim device 25 can be switched between the automatic control mode and the manual control mode by either the UP button 230 or the DN button 231.

The motion range under the automatic control mode is settable between the full trim-in position and the full tilt-out position by the input device 27. Because of this, the motion range under the automatic control mode is settable by either a user or a dealer.

When the PTT switch 23 is operated during the tilt-trim motion under the automatic control mode, the controller 21 causes the tilt-trim device 25 to stop the tilt-trim motion.

Accordingly, when the PTT switch 23 is operated by the user, the automatic control mode can be stopped along the way.

When the value of change in the tilt-trim position of the outboard motor 2 within the predetermined period of time is less than or equal to the predetermined threshold Th1, the controller 21 causes the tilt-trim device 25 to stop the tilt-trim motion. Accordingly, a foreign object can be inhibited from getting stuck in the tilt-trim device 25.

Even if the operation has been performed the plurality of times within the predetermined period of time, the controller 21 prohibits starting the automatic control mode when the engine is being driven. Accordingly, either the outboard motor 2 or the tilt-trim device 25 can be prevented from being damaged or broken.

One preferred embodiment of the present invention has been explained above. However, the present invention is not limited to the aforementioned preferred embodiment, and a variety of changes can be made without departing from the gist of the present invention.

The PTT switch 23 is not limited to the push-button switch, and alternatively, may be another type of switch such as a rotary switch or a slide switch. Furthermore, the PTT switch 23 is not limited to be composed of the at least one hard key, and alternatively, may be composed of at least one software key displayed on the touch screen. As a condition to be satisfied for starting the automatic control mode, the frequency of operating the PTT switch 23 within the predetermined period of time is not limited to twice, and alternatively, may be three times or greater. A condition to be satisfied for stopping the tilt-trim motion under the automatic control mode is not limited to that in the aforementioned preferred embodiment, and may be changed.

Figure 8:
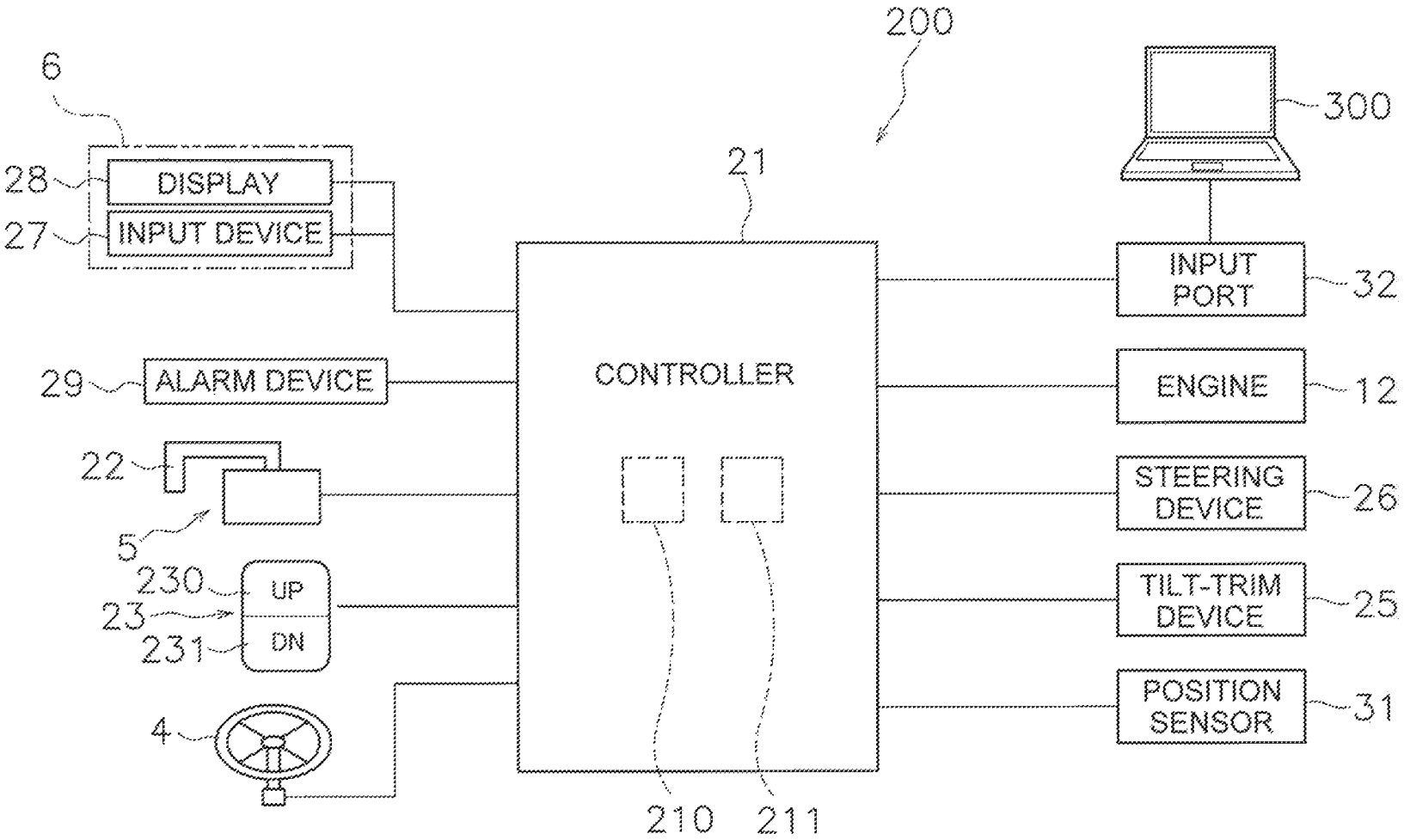
FIG. 8 is a schematic diagram of a control system for an outboard motor according to a modification.

In the aforementioned preferred embodiment, the motion range of the tilt-trim motion under the automatic control mode is set by operating the input device 27 mounted to the watercraft 1. However, the motion range of the tilt-trim motion under the automatic control mode may be set by operating another device. FIG. 8 is a schematic diagram of a control system 200 for the outboard motor 2 according to a modification.

As shown in FIG. 8, the control system 200 according to the modification may include an input port 32 to which a signal is inputted from an external machine 300. The external machine 300 is a computer device such as a PC (Personal Computer). The input port 32 receives the signal from the external machine 300 through wired or wireless communication. The controller 21 receives the signal from the external machine 300 through the input port 32.

Software as a tool for setting the motion range has been installed in the external machine 300. The external machine 300 causes the display 28 thereof to display the aforementioned setting screen 40 for setting the motion range. The motion range is set as described above by either a user or a dealer through the operation of the external machine 300. For example, the external machine 300 may include a pointing device, for instance, and either the upper limit setting button 41 or the lower limit setting button 42 may be operated through the pointing device. The external machine 300 outputs a setting signal indicating the setting of the motion range, and the controller 21 receives the setting signal through the input port 32. Thus, the motion range of the tilt-trim motion under the automatic control mode may be set by operating the external machine 300.

What is claimed is:

1. A tilt-trim system for an outboard motor, the tilt-trim system comprising:
- a tilt-trim device;
- an operating switch configured to operate the tilt-trim device; and
- a controller connected to the tilt-trim device and the operating switch, the controller having a processor programmed to
  - determine whether or not an operation of the operating switch has been performed a plurality of times within a predetermined period of time upon receiving a signal indicating the operation of the operating switch,
  - control the tilt-trim device under an automatic control mode such that the tilt-trim device automatically causes the outboard motor to continuously perform a tilt-trim motion within a motion range set in advance upon determining the operation has been performed the plurality of times within the predetermined period of time,
  - deactivate the tilt-trim device upon determining the outboard motor reaches either an upper limit or a lower limit of the motion range, and
  - change the motion range in accordance with a setting signal for setting the motion range upon receiving the setting signal.

2. The tilt-trim system according to claim 1, further comprising:
- an input port to which a signal from an external machine is inputted,
- the controller being configured to receive the setting signal through the input port.

3. The tilt-trim system according to claim 1, wherein
- the controller is further programmed to deactivate the tilt-trim device upon detecting the operation of the operating switch during the tilt-trim motion of the outboard motor under the automatic control mode.

4. The tilt-trim system according to claim 1, further comprising:
- an outboard motor position sensor configured to output a signal indicative of a position of the outboard motor during the tilt-trim motion,
- the controller being further programmed to
  - receive the signal indicating the position of the outboard motor from the outboard motor position sensor during the tilt-trim motion under the automatic control mode, and
  - deactivate the tilt-trim device upon determining a value of change in the position of the outboard motor within a predetermined period of time is less than or equal to a predetermined threshold.

5. The tilt-trim system according to claim 1, further comprising:
- an alarm device,
- the controller being further programmed to control the alarm device to output an alarm during the tilt-trim motion of the outboard motor under the automatic control mode.

6. The tilt-trim system according to claim 1, wherein
- the outboard motor includes an engine,
- the controller is further programmed to
  - determine whether or not the engine is being driven, and
  - prohibiting starting the automatic control mode upon determining the engine is being driven even if the operation has been performed the plurality of times within the predetermined period of time.

7. A method of controlling a tilt-trim device causing an outboard motor to perform a tilt-trim motion, the method comprising:

receiving a signal indicating an operation of an operating switch for operating the tilt-trim device;

determining whether or not the operation has been performed a plurality of times within a predetermined period of time;

controlling the tilt-trim device under an automatic control mode such that the tilt-trim device automatically causes the outboard motor to continuously perform the tilt-trim motion within a motion range set in advance upon the operating switch being operated the plurality of times within the predetermined period of time;

deactivating the tilt-trim device upon the outboard motor reaching either an upper limit or a lower limit of the motion range; and changing the motion range in accordance with a setting signal for setting the motion range upon receiving the setting signal.

8. The method according to claim 7, further comprising:

deactivating the tilt-trim device upon detecting the operation of the operating switch during the tilt-trim motion of the outboard motor under the automatic control mode.

9. The method according to claim 7, further comprising:

receiving a signal indicating a position of the outboard motor during the tilt-trim motion under the automatic control mode; and deactivating the tilt-trim device upon a value of change in the position of the outboard motor within a predetermined period of time being less than or equal to a predetermined threshold.

10. The method according to claim 7, further comprising:

outputting a command signal to issue an alarm during the tilt-trim motion of the outboard motor under the automatic control mode.

11. The method according to claim 7, further comprising:

determining whether or not an engine of the outboard motor is being driven; and prohibiting starting the automatic control mode while the engine being driven even if the operation has been performed the plurality of times within the predetermined period of time.

* * * * *